US005199930A

United States Patent [19]

Weber

[11] Patent Number: 5,199,930

[45] Date of Patent: Apr. 6, 1993

[54] ADJUSTABLE TRAINING HURDLE

[76] Inventor: Dennis W. Weber, Rte. 1, Box 42, Baldwin City, Kans. 66006

[21] Appl. No.: 726,857

[22] Filed: Jul. 8, 1991

[51] Int. Cl.[5] ..... A63B 5/02

[52] U.S. Cl. ..... 482/17; 248/439; 248/164; 211/200; 108/117; 108/120

[58] Field of Search ..... 38/103, 137; 108/117, 108/120; 482/15, 16, 17; 248/164, 439; 211/200

[56] References Cited

U.S. PATENT DOCUMENTS

| | | | |
|---|---|---|---|
| 1,044,128 | 11/1912 | Brook | 482/17 |
| 2,693,652 | 11/1954 | Kutz | 108/117 |
| 3,174,443 | 3/1965 | Egger | 108/117 |
| 3,685,824 | 8/1972 | Quinn | 482/17 |
| 4,244,300 | 1/1981 | Leach | 108/116 |
| 4,596,388 | 6/1986 | Burden . | |
| 4,793,288 | 12/1988 | Hoadley . | |
| 4,892,302 | 1/1990 | Daigle . | |
| 4,993,706 | 2/1991 | Wilkinson | 108/117 X |
| 5,033,737 | 7/1991 | Moye | 482/17 |

FOREIGN PATENT DOCUMENTS

| | | | |
|---|---|---|---|
| 810848 | 3/1959 | United Kingdom | 482/17 |

*Primary Examiner*—Richard J. Apley
*Assistant Examiner*—Karen A. Jalbert
*Attorney, Agent, or Firm*—D. A. N. Chase; Michael Yakimo, Jr.; Richard P. Stitt

[57] ABSTRACT

An adjustable height training hurdle is provided for which allows variation of the height of the hurdle from near ground level up to regulation height. A slip gear is utilized to create a scissor action of the hurdle legs thus offering incremental adjustment of the hurdle height.

18 Claims, 1 Drawing Sheet

ADJUSTABLE TRAINING HURDLE

The present invention is related to the field of sports equipment more particularly track and field hurdle racing and specifically a hurdle providing adjustment of the distance between the top of the hurdle and the ground.

BACKGROUND OF THE INVENTION

Track and field hurdle events, or simply "the hurdles," occur in two general forms a 100 meter race and a 400 meter race. As the distance in the two forms of hurdle events is substantially different, most athletes do not compete in both events, but specialize in one or the other. This is a direct function of the distance of the two races. The shorter race is essentially a sprint race including obstacles to jump over and the longer race being a longer endurance-type race including obstacles.

In the shorter 100 meter hurdle event it is necessary that the runner display essentially the form of a sprinter. However, with every fourth stride the runner must leap a hurdle with only such interruption to the sprint racing running form as is necessary to leap the hurdle. Support for the critical nature of minimizing alteration of the sprinting form can be seen in the total time difference in running 100 meters with hurdles and without hurdles. Competent hurdlers have approximately only a two second longer time in the running of a 100 meter distance with the 10 hurdles included. As a general measure it is believed that when the variation between a 100 meter sprint and 100 meter hurdle event is four seconds or less that the runner is displaying a high degree of efficiency of motion in running the hurdle event.

As in sprinting starting blocks are used to begin the hurdle event. Once out of the starting blocks running the 100 meter hurdles precedes much as a 100 meter sprint in that the runner uses forceful arm movement and horizontal movement along the track to maximize acceleration during the first 3 to 4 strides. It is important that the hurdler concentrate on proper sprinting form to maximize speed in the 100 meter race and that the inclusion of leaping the hurdles not compromise this sprinting form.

Thus, it may be appreciated that to novice hurdlers, attempting to simultaneously develop or maintain proper sprinting form while leaping a hurdle, the requirement to leap hurdles of regulation height can present a substantial barrier to development and maintenance of proper sprinting form. Therefore, it is apparent that the ability to conveniently and easily vary the height of a training hurdle to conform to the particular runner's height and ability to jump will be of substantial importance to both the athlete and the coach in the development of successful hurdling technique.

The 400 meter hurdle race must be approached quite differently from the 100 meter hurdles. In this longer distance hurdlers must adhere to a race plan which is individualized and based upon the runners particular stature, length of stride and endurance.

Because of the longer distance presented, endurance and efficient technique become major considerations in successfully running the 400 meter hurdles. A lack of endurance towards the end of a race can result in the runner failing to clear the hurdle, thus bumping into hurdle and causing a substantial reduction in speed and possible injury. Also, due to the longer distance it may be necessary for runners to contend with learning to alternate lead legs in approaching the hurdles.

In running the 400 meter hurdles most hurdlers find it necessary to alter their stride pattern as fatigue increases during the race. This is known as "change down" and is a technique whereby the runner increases slightly the number of strides between hurdles. This changing of the stride pattern must be smooth and occur gradually over the entire stride of the runner. Thus, in training, it may be important for the runner to be presented with a situation in which they may concentrate upon the smooth alteration of their stride without needing to concentrate on leaping a regulation height hurdle.

A common problem faced by track and field coaches is a limitation of money available to purchase equipment. Therefore, it is advantageous when a single piece of equipment is adjustable and may be conformed to many alternative uses. Typically track hurdles are presented in specific heights which are in conformance with the regulation heights of a hurdle for racing. Such a fixed hurdle is of little utility to a coach training novice hurdlers or younger students. These persons may be unable to comfortably leap, or leap at all, the regulation height hurdle. This can lead to discouragement of the novice hurdler or younger child in attempting hurdles or, worse yet, may cause injury to those attempting to leap regulation height hurdles.

Therefore, it is an object of the present invention to provide a track and field hurdle which has full adjustment in its height.

Another object of the present invention is to provide a variable height training hurdle which will easily fall over when contacted so as to avoid causing injury to novice hurdlers.

Another object of the present invention is to provide a teaching aid for elementary students and novice hurdlers which may be conformed to their particular stature and leaping abilities by adjustment of the hurdle height.

Yet another object of the present invention is to provide a track hurdle which can be positioned incrementally to increasing heights so as to permit a novice hurdler to develop and maintain proper hurdling form while incrementally increasing the height of the hurdle.

A further object of the present invention is to generally provide a physical education obstacle or hurdle which may be utilized by a physical education teacher or coach as part of an obstacle course or for instilling the principles of hurdling or leaping obstacles while conforming the obstacle to an appropriate height for the individual.

Another object of the present invention is to provide a track hurdle which is inexpensive.

Yet another object of the present invention is to provide a track hurdle which can be easily and rapidly adjusted from a first height off the ground to a second height off the ground.

Another object of the present invention is to provide a track hurdle which can be easily moved and stored and which is suitable for indoor use upon gymnasium floors.

Other objects and advantages of this invention will become apparent from the following description taken in connection with the accompanying drawings, wherein is set forth by way of illustration and example, an embodiment of this invention.

DESCRIPTION OF THE PREFERRED EMBODIMENTS

Figure 1:
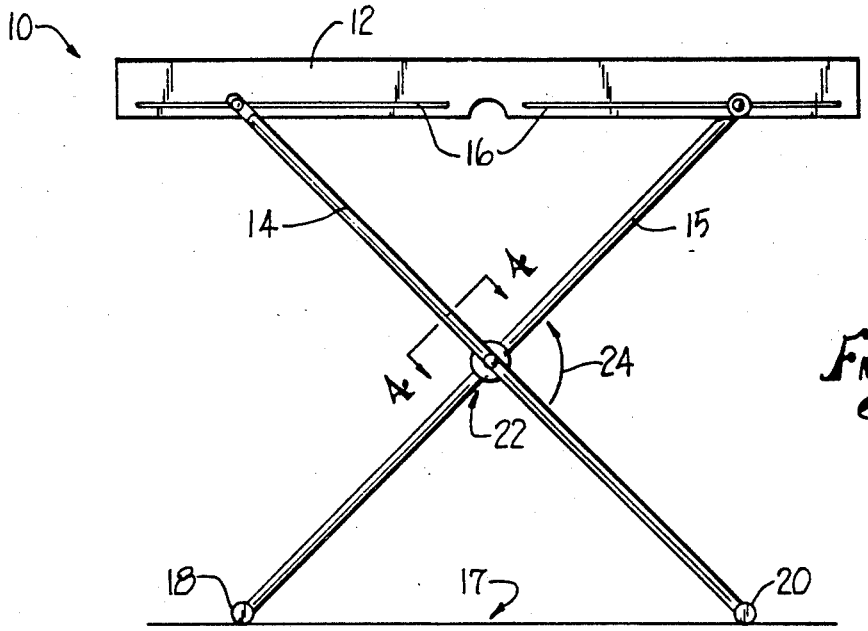
FIG. 1 is a front elevational view of the inventive hurdle illustrating the hurdle raised to a regulation height.

Referring to FIG. 1, the inventive hurdle 10 is illustrated in a raised position of approximately 30" in height so as to be used in conventional track and field competitions. Hurdle board 12 may be of plastic or wood or of any material having sufficient stiffness to maintain legs 14, 15 in proper conformation and not sag. An end of leg 14, 15 is attached to hurdle board 12 by insertion of a fastener such as a wire, screw, bolt or pin through an end of leg 14, 15 and slot or groove 16 in hurdle board 12. This provides a means for slidable movement or displacement for the ends of legs 14, 15 along the length of groove 16. This slidable displacement permits repositioning of the ends of legs 14, 15 with respect to hurdle board 12 as changes in angle theta 24 and in the distance between hurdle board 12 and feet 18, 20 occur.

Still referring to FIG. 1 the operation of a means for pivotal movement between legs 14, 15 will be discussed. Legs 14, 15 are secured together near the midpoint of legs 14, 15. In the preferred embodiment this is accomplished through the use of a circular slip gear 22 which permits legs 14, 15 to rotate or pivot with respect to each other in a scissors like fashion. This scissors like movement of legs 14, 15 permits the adjustment of height of hurdle board 12 above the ground or above feet 18, 20. This adjustment in height also may be expressed as a change in angle theta 24. When it is desired to place hurdle board 12 in an extremely low position near the ground or near feet 18, 20 downward pressure is applied to the top of hurdle board 12. This pressure must be sufficient to overcome the frictional engagement of the two halves or members 40, 42 (FIG. 4) of slip gear 22 to result in downward movement of hurdle board 12 and a reduction of angle theta 24 as the top of leg 15 moves downward and approaches foot 20 of leg 14. As this occurs hurdle board 12 nears ground 17 or nears feet 18, 20. Thus, the height of hurdle board 12 above the ground is reduced. In a similar manner the reverse of this process will cause the distance between hurdle board 12 and feet 18, 20 to increase as angle theta 24 is increased.

To raise the height at which hurdle board 12 is presented above ground 17, or above feet 18, 20 a hurdler pulls upwardly on hurdle board 12 with sufficient rapidity to generate a force capable of overcoming the frictional, engagement between members 40, 42 (FIG. 4) of slip gear 22. In this manner angle theta 24 is increased and the height of hurdle board 12 above the ground or above feet 18, 20 is also increased. Thus the raising of hurdle board 12 to a higher hurdle position is accomplished.

Figure 2:
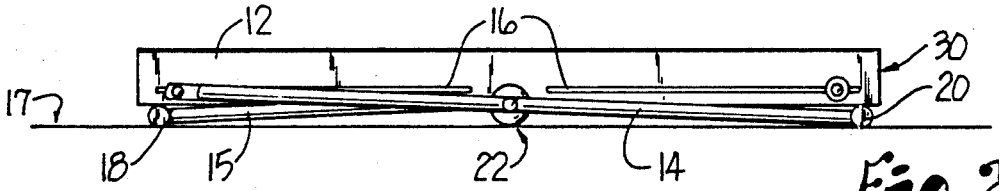
FIG. 2 is a front elevational view of the present invention in its fully collapsed position.

Referring now to FIG. 2, the preferred embodiment of the present invention is illustrated in a collapsed position. As may be observed angle theta 30 is very nearly zero thus presenting hurdle board 12 close to feet 18, 20 and nearly in contact with ground 17. Therefore, as may be appreciated from FIG. 1 and FIG. 2 and the description thereof, hurdle 10 may be rapidly converted to substantially different heights above ground 17. This is especially convenient in the training of school children who, as a group, present great variation in height. The present invention allows the instructor of such a group of children to quickly change the height of the hurdles to enable children of different heights to jump the hurdles. This feature of height adjustments allows formation of a hurdle which is in proper relation to the child's height as well as offering the child the proper element of challenge in leaping the hurdle.

Of particular importance to hurdlers and coaches is the ability of the present invention to undergo rapid and convenient incremental change in height. This permits proper training of hurdlers by allowing the initial training of the hurdler at a lower than regulation hurdle height. In this manner a hurdler is able to approach and leap a lower height hurdle. Thus the novice hurdler is able to maintain proper sprinting or running form while learning to hurdle. This development of proper form is essential to successful hurdling. If the novice hurdler is immediately expected to undertake regulation height hurdles the result may be a sacrifice of proper hurdle jumping style and sprinting and running form which may result in future bad habits and a loss of speed in racing.

This development of proper form is essential when it is understood that only minor differences in proper form exist between a hurdler and a sprinter. That is to say, a hurdler with proper form only will vary from a sprinter's form during the moments at which the hurdle is actually jumped. Thus the present invention, by allowing modifications in hurdle height and by allowing progressive increase in the height of the hurdle, permits the novice hurdler to develop and maintain proper form as the ability to negotiate higher hurdles is accomplished.

Figure 3:
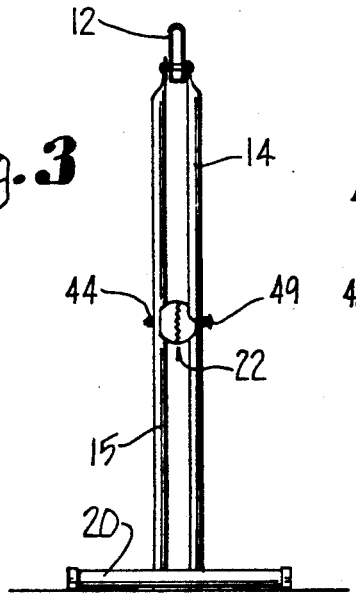
FIG. 3 is a side elevational view of the inventive hurdle as shown in FIG. 1.

Referring to FIG. 3 a side elevational view of the inventive hurdle is illustrated. In the preferred embodiment feet 18, 20 extend from and perpendicular to legs 14, 15. As shown in FIG. 3, feet 18, 20 extend to either side of legs 14, 15. However, alternatively, a weighted foot can be extended to one side only in the fashion of conventional hurdles. Such a single sided foot can be weighted so as to permit the hurdle to be knocked over by the runner's foot or leg.

Figure 4:
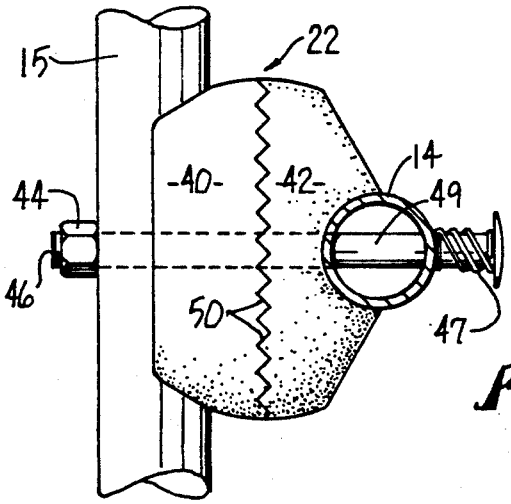
FIG. 4 is a side elevational view of the leg pivot or slip gear apparatus on an enlarged scale showing the attachment of each gear half to each leg by a fastener and having the legs cut away for clarity.

Referring now to FIG. 4, an enlarged side elevational view of the leg pivot or slip gear is shown with legs 14, 15 truncated for clarity. It may be observed that slip gear 22 is comprised of two members or gear halves 40, 42. Each gear half is formed to allow legs 14, 15 to fit into a depression and to be securely held in contact with the gear half. Fastener 49 passes through legs 14, 15 and gear halves 40, 42. In the preferred embodiment, legs 14, 15 and gear halves 40, 42 are fastened by bolt 49 which passes through legs 14, 15 and gear halves 40, 42 and are secured together by nut 44 on threaded portion 46 of bolt 49. Gear halves 40, 42 are equipped with registrable teeth 50. Teeth 50 are radially spaced on the face of gear halves 40, 42 and extend in spoke-like array along the radius of each of gear halves 40, 42. Teeth 50 serve to securely hold the position of gear halves 40, 42 and relative to one another. This is accomplished by maintaining pressure to create sufficient contact between teeth 50 of gear halves 40, 42 such that slippage and unwanted rotation will not occur, but that with proper pressure placed upon hurdle board 12 slippage or forced rotation of gear halves 40, 42 will occur. This is accomplished through the use of spring 47 on bolt 49. Spring 47 biases gear half 40 against gear half 42 and thereby provides sufficient contact between gear halves 40, 42 to prevent slippage. If slippage occurs or if greater frictional contact between teeth 50 of gear halves 40, 42 is desired, nut 44 on threads 46 of fastener 49 may be tightened to further compress spring 47 and thus increase the amount of force required to effect rotation between gear halves 40, 42.

A frictional engagement between slip gear 22 has been discussed. However, it should be appreciated that any frictional or compression engagement between legs 14, 15 will satisfactorily substitute for slip gear 22. One such alternative embodiment may be in the form of a quick release compression fitting substituted at the location of slip gear 22 in the preferred embodiment, or the use of an alternate fastener to maintain legs 14, 15 in position so as to allow selection and maintenance of angle theta 24.

A measuring scale may be included in an embodiment of the invention. The measurement scale is utilized to determine the height of hurdle board 12 above the ground. The measurement scale may be protractor type arrangement added to legs 14, 15 to measure angle theta 24 and to translate the angle into a distance above the ground of hurdle board 12. In the preferred embodiment, a scale is provided on hurdle board 12 adjacent to groove 16. As the end of legs 14, 15 attached to hurdle board 12 move within groove 16 the particular position of the ends of legs 14, 15 indicates a specific height above the ground of hurdle board 12 on the scale. In this manner the scale attached to hurdle board 12 permits convenient determination of the height above the ground of hurdle board 12 as an adjustment is being made.

Having thus described the invention, what is claimed as new and desired to be secured by Letters Patent is:

1. A track hurdle, comprising:
- a hurdle board;
- at least two legs each having a first end and a second end;
- a gear interconnecting said at least two legs, said gear being responsive to a vertically applied force on said hurdle to pivot said legs, said gear comprising:
  - a first gear member associated with a first of at least two legs;
  - a second gear member associated with a second of at least two legs;
  - means for joining in rotational relation said first gear member and said second gear member;
- mean for urging said first gear member against said second gear member to maintain said legs in a selected position; and
- means for adjustable attachment of said first leg ends to said hurdle boar to allow said vertically applied force to adjust the distance between said second leg ends and said hurdle board.

2. The hurdle as claimed in claim 1 further comprising a foot member attached to said second leg ends.

3. The hurdle as claimed in claim 2 wherein said foot member is weighted.

4. The hurdle as claimed in claim 1 further comprising means for measurement of said hurdle board height above the ground.

5. The hurdle as claimed in claim 4 wherein said means for measurement is a scale adjacent to said means for adjustable attachment whereby the distance of said hurdle board from said second leg ends may be determined.

6. The hurdle as claimed in claim 4 wherein said means for measurement is a scale adjacent to said means for pivotal movement whereby the separation between said at least two legs indicates the distance between said hurdle board and said second leg ends.

7. The hurdle as claimed in claim 1 wherein said means for adjustable attachment comprises:
- said hurdle board having a longitudinal slot therein; and
- a fastener to slidably associate said first leg ends with said slot such that said first leg ends may be displaced along said slot in response to pivotal movement between said at least two legs.

8. The hurdle as claimed in claim 1 wherein said means for urging is a spring.

9. The hurdle as claimed in claim 1 wherein said means for joining is a bolt.

10. The hurdle as claimed in claim 1 further comprising registerable teeth on said gear members for incremental adjustment of the distance between said second leg ends and said hurdle board.

11. A track hurdle, comprising:
- a hurdle board having a longitudinal slot therein;
- a plurality of legs each leg having a first end and a second end;
- a fastener providing slidable attachment of said first leg ends with said longitudinal slot such that said first leg ends may be displaced along said slot; and
- a slip gear interconnecting said plurality of legs for pivotal movement such that pivotal leg movement results in slidable displacement of said first leg ends in said longitudinal slot and variation of the distance between said hurdle board and said second leg end.

12. The hurdle as claimed in claim 11 further comprising registerable teeth on said slip gear for incremental adjustment of the distance between said second leg ends and said hurdle board.

13. The hurdle as claimed in claim 11 further comprising a foot member attached to said second leg ends.

14. The hurdle as claimed in claim 11 further comprising means for measurement of said hurdle board height above the ground.

15. The hurdle as claimed in claim 14 wherein said means for measurement is a scale adjacent to said means for slidable attachment whereby the distance of said hurdle board from said second leg ends may be determined.

16. A track hurdle, comprising:
- a hurdle board having a longitudinal slot therein;
- at least two legs each having a first end and a second end;
- a fastener providing slidable attachment of said first leg ends with said longitudinal slot such that said first leg ends may be displaced along said slot;
- a gear interconnecting said at least two legs, said gear being responsive to a vertically applied force on said hurdle to pivot said legs, said gear comprising:
  - a first gear member associated with a first of at least two legs;
  - a second gear member associated with a second of at least two legs;

means for joining in rotational relation said first gear member and said second gear member; and means for biasing said first gear member against said second gear member to maintain said legs in a selected position such that said vertically applied force forces rotation of said first gear member relative to said second gear member to adjust the distance between said second leg ends and said hurdle board.

17. The hurdle as claimed in claim 16 wherein said means for biasing is a spring forcing said first gear member against said second gear member.

18. The hurdle as claimed in claim 16 further comprising registerable teeth on said gear member for incremental adjustment of the distance between said second leg ends and said hurdle board.

* * * * *

UNITED STATES PATENT AND TRADEMARK OFFICE

CERTIFICATE OF CORRECTION

PATENT NO. : 5,199,930

DATED : April 6, 1993

INVENTOR(S) : Dennis W. Weber

It is certified that error appears in the above-identified patent and that said Letters Patent is hereby corrected as shown below:

Claim 1, Column 5, line 55, delete "mean" and insert --means--
line 59, after the word "hurdle" delete "boar" and insert --board--

Claim 18, Column 8, line 7, after the word "gear" delete "member" and insert --members--

Signed and Sealed this

Twenty-third Day of November, 1993

Bruce Lehman

*Attest:*

BRUCE LEHMAN

*Attesting Officer*

*Commissioner of Patents and Trademarks*